US005174414A

United States Patent [19]

Burns

[11] Patent Number: 5,174,414

[45] Date of Patent: Dec. 29, 1992

[54] SERVICE LIFT STAND APPARATUS FOR SMALL IMPLEMENTS

[76] Inventor: Richard H. Burns, 662 Clarendon Rd., Troy, Ohio 45373

[21] Appl. No.: 736,627

[22] Filed: Jul. 26, 1991

[51] Int. Cl.[5] ..... B66B 9/20

[52] U.S. Cl. ..... 187/9 R; 187/8.41; 254/90

[58] Field of Search ..... 187/9 R, 9 E, 8.41, 187/8.45, 8.47, 24, 25; 254/7, 134, 90, 89 H, 2 R; 182/141, 148

[56] References Cited

U.S. PATENT DOCUMENTS

| | | | |
|---|---|---|---|
| 2,895,567 | 7/1959 | Hall | 187/9 R |
| 3,309,060 | 3/1967 | Villars | 254/7 |
| 3,318,417 | 5/1967 | Royce | 187/8.41 |
| 3,749,201 | 7/1973 | Clarke | 187/9 R |
| 3,779,517 | 12/1973 | Fisher | 254/134 |
| 3,838,783 | 10/1974 | Tune | 214/49 |
| 4,084,790 | 4/1978 | Molnar | 254/90 |
| 4,267,901 | 5/1981 | Tsujimura | 187/8.54 |
| 4,328,951 | 5/1982 | Laupper | 254/89 H |
| 4,427,094 | 1/1984 | Winkelblech | 187/9 R |
| 4,531,614 | 7/1985 | Naegeli | 187/8.5 |
| 4,585,092 | 4/1986 | Dossier | 187/8.45 |
| 4,984,657 | 1/1991 | Burns | 187/8.47 |

FOREIGN PATENT DOCUMENTS

| | | | |
|---|---|---|---|
| 2906080 | 2/1979 | Fed. Rep. of Germany | 254/90 |
| 2333745 | 5/1975 | France | 254/90 |
| 385898 | 9/1973 | U.S.S.R. | 254/90 |

OTHER PUBLICATIONS

G & H Model 370-A Lawnmower Stand Repair Parts List, G & H Products, Inc. St. Paris, Ohio.

Uni-Lift Model 370D Repair Lift Parts List, G & H Products, Div. of Riburn Industries, Inc. St. Paris, Ohio.

*Primary Examiner*—Robert P. Olszewski
*Assistant Examiner*—Kenneth Noland
*Attorney, Agent, or Firm*—John R. Flanagan

[57] ABSTRACT

A service lift stand apparatus includes a support frame assembly, a lift platform assembly, and a drive arrangement. The support frame assembly is composed of a horizontal lower base and a vertical mast mounted in an upstanding orientation on the base. The lift platform assembly is mounted to the upright mast for reciprocal movement vertically therealong. The drive arrangement is supported on the support frame assembly and is operable to movably drive the lift platform assembly in upward and downward directions along the upright mast away from and toward the base of the support frame assembly. The drive arrangement includes a vertical drive screw shaft rotatably mounted to the mast and coupled to the lift platform assembly for driving the lift platform assembly vertically along the mast, and a drive motor mounted on the base and having an output drive shaft intercoupled to the screw shaft. The lift platform assembly includes a support structure mounted to the mast for reciprocal vertical movement along the mast, a pair of elongated wheel support troughs mounted to the support structure for pivotal movement relative to the support structure and for lateral movement toward and away from each other along the support structure, and a mechanism for locking the wheel support troughs in desired positions along the suppport structure for supporting the work implement.

17 Claims, 3 Drawing Sheets

SERVICE LIFT STAND APPARATUS FOR SMALL IMPLEMENTS

TECHNICAL FIELD

The present invention generally relates to a lift apparatus and, more particularly, is concerned with a service lift stand apparatus for small work-type implements.

BACKGROUND ART

Small work-type implements, such as walk-behind lawnmowers, small snow blowers, and power washers, have been in widespread use for many years. These small work implements save considerable time and energy for their users. However, as with any work implement, they require periodic maintenance and repair in order to keep them in good working order.

Because of the size and construction of these small work implements, it is difficult to perform repairs or maintenance on them when they are resting in their normal position on the ground. Thus, it is desirable to provide an apparatus for raising such implements to enable a mechanic or service person to more easily perform the required repairs or maintenance.

Lift apparatuses of many different constructions are found in the prior art. Representative examples of lift apparatuses are the ones disclosed in U.S. Pat. Nos. to Yillars (3,309,060), Royce (3,318,417), Fisher (3,779,517), Tune (3,838,783), Molnar (4,084,790), Tsujimura (4,267,901), Laupper (4,328,951), Naegeli (4,531,614), Dossier (4,585,092) and Burns (4,984,657), and in French Patent No. 2,333,745, German Patent No. 2,906,080 and USSR Inventors Certificate No. 385,898.

One service lift stand apparatus identified by the trademark UNI-LIFT and manufactured and marketed by Riburn Industries, Inc., of St. Paris, Ohio, is well suited particularly for lifting and supporting small work implements for repair and maintenance. In terms of overall performance and commercial acceptance, the UNI-LIFT service lift stand apparatus has met and even surpassed expectations. However, as occurs from time to time in the case of most equipment, a need arises to make improvements that will increase productivity and performance of such service lift stand apparatus even further.

DISCLOSURE OF INVENTION

The present invention provides an improved service lift stand apparatus designed to satisfy the aforementioned needs. The improved service lift stand apparatus of the present invention has several features which enhance its performance, productivity and ease-of-use.

Basically, the service lift stand apparatus includes a support frame assembly, a lift platform assembly, and a drive arrangement. The support frame assembly is composed of a generally horizontal lower base and a generally vertical mast mounted in an upstanding orientation on the base. The lift platform assembly for supporting a work implement to be serviced is mounted to the upright mast for reciprocal movement in a generally vertical path along the upright mast. The drive arrangement is supported on the support frame assembly and is operable to movably drive the lift platform assembly in upward and downward directions along the upright mast away from and toward the base of the support frame assembly.

One feature of the improved service lift stand apparatus of the present invention relates to the drive arrangement and its mounting relationship with the lift platform and support frame assemblies of the apparatus. The drive arrangement includes a generally vertically-extending drive screw shaft rotatably mounted to the vertical mast and lower base and coupled to the lift platform assembly for driving the lift platform assembly along the vertical path. The drive arrangement also includes a drive motor mounted on the lower base and having an output drive shaft extending generally parallel to the drive screw shaft. The drive arrangement further includes a drive motion transmitting train intercoupling the output drive shaft of the drive motor to the drive screw shaft.

Another feature of the improved service lift stand apparatus of the present invention relates to the construction of the lift platform assembly and its mounting relationship with the support frame assembly of the apparatus. The lift platform assembly includes a support structure mounted to the upright mast for reciprocal movement in the generally vertical path along the upright mast, a pair of elongated lift members, preferably in the form of a pair of elongated wheel support troughs, mounted to the support structure for generally parallel pivotal movement relative to the support structure and for lateral movement toward and away from each other along the support structure for adjusting the desired positions of the lift members relative to each other, and means for locking the lift members in the desired positions along the support structure for supporting the work implement.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF DRAWINGS

In the following detailed description, reference will be made to the attached drawings in which.

BEST MODE FOR CARRYING OUT THE INVENTION

Figure 1:
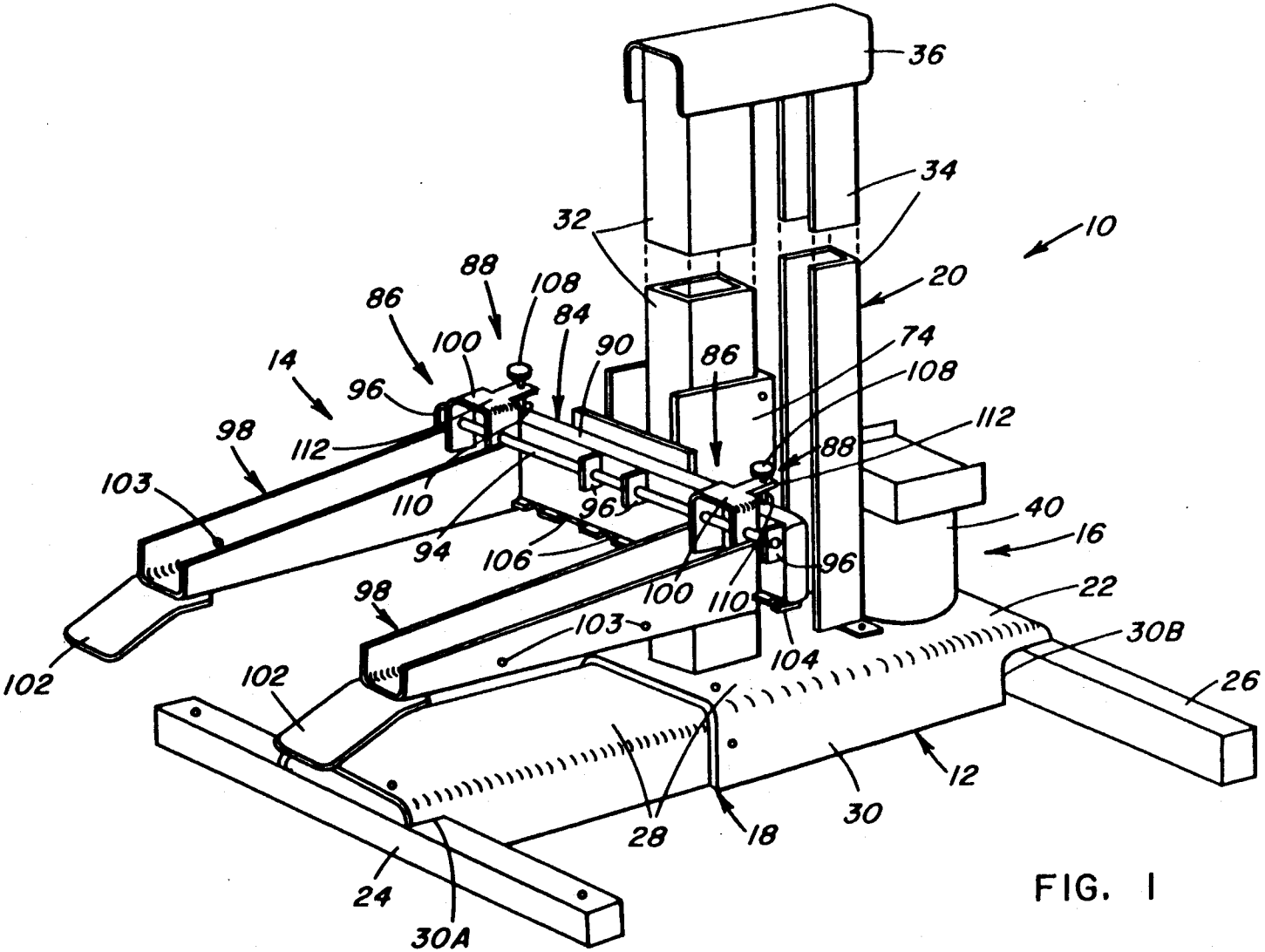
FIG. 1 is a perspective view of an improved service lift stand apparatus of the present invention.

Referring now to the drawings, and particularly to FIG. 1, there is shown an improved service lift stand apparatus, generally designated 10, incorporating the features of the present invention. Basically, the lift stand apparatus 10 includes a support frame assembly 12, a lift platform assembly 14 movably mounted to the support frame assembly 12 for supporting a work implement, and a drive arrangement 16 being operable for vertically moving the lift platform assembly 14 relative to the support frame assembly 12.

The support frame assembly 12 of the lift stand apparatus 10 is composed of a generally horizontal lower base 18 and a generally upright extending mast 20 rigidly mounted in upstanding fashion on the base 18. The lift platform assembly 14 is mounted to the upright mast 20 of the support frame assembly 12 for reciprocal movement in a generally vertical path therealong. The drive arrangement 16 is supported on the support frame assembly 12 and is operable to movably drive the lift platform assembly 14 in upward and downward directions along the upright mast away from and toward the lower base 18 of the support frame assembly 12.

Figure 2:
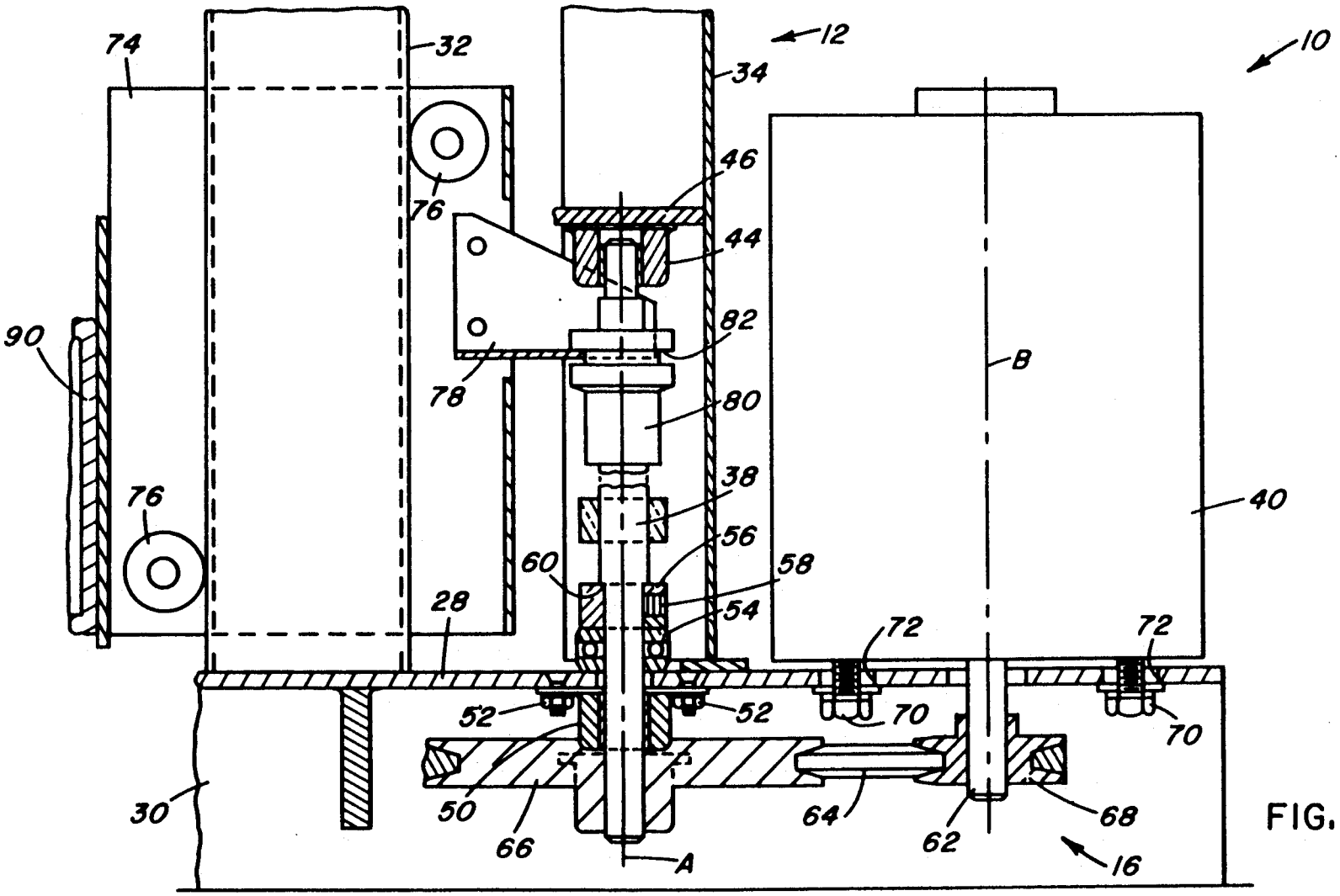
FIG. 2 is an enlarged fragmentary, foreshortened and partly sectioned, side elevational view of a drive arrangement and support frame assembly of the lift stand apparatus of FIG. 1.
Figure 4:
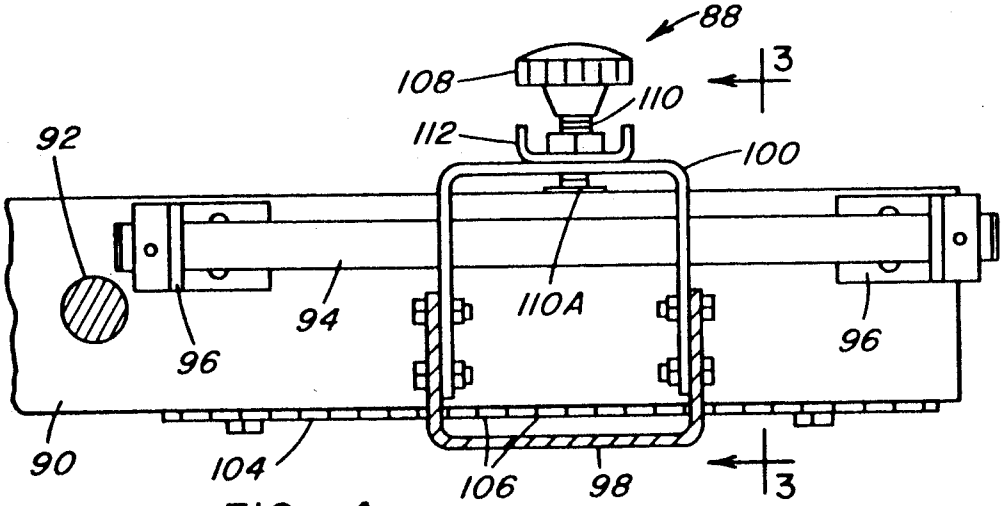
FIG. 4 is a front elevational view of a right half of the lift platform assembly as seen along line 4—4 of FIG. 3.
Figure 3:
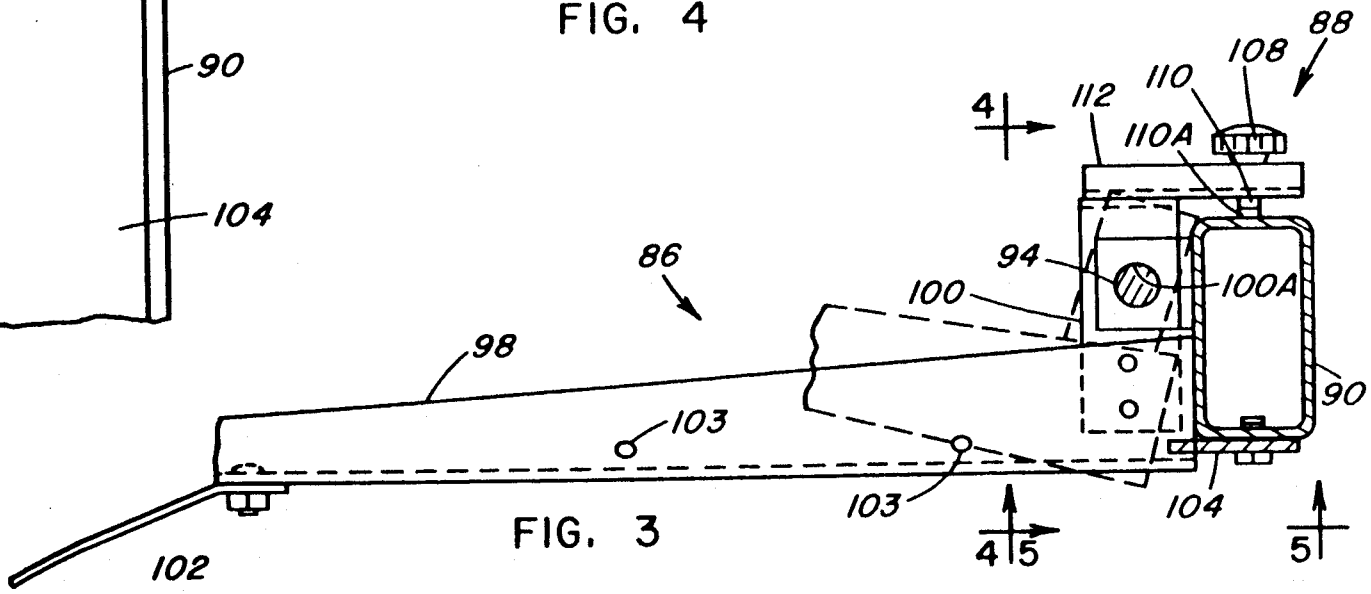
FIG. 3 is an enlarged side elevational, partly sectioned, view of a lift platform assembly of the lift stand apparatus as seen along line 3—3 of FIG. 4.
Figure 5:
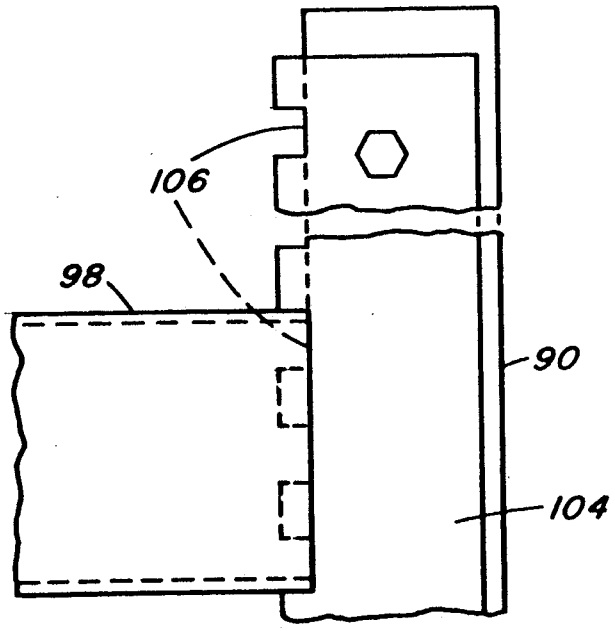
FIG. 5 is an enlarged fragmentary bottom plan view of the lift platform assembly as seen along line 5—5 of FIG. 3.

Referring to FIGS. 1 and 2, the lower base 18 of the support frame assembly 12 includes a longitudinal, or fore-and-aft, extending main body 22 and a pair of front and rear stabilizing transverse legs 24, 26 attached across front and rear ends of the main body 22. The main body 22, being of an inverted U-shaped cross-sectional configuration, has a horizontal top wall 28 and a pair of opposite vertical side walls 30 integrally connected along longitudinal edges of the top wall 28. The front and rear ends of the side walls 30 have cutouts 30A, 30B into which are fitted the front and rear transverse legs 24, 26 of the lower base 18.

The upright mast 20 of the support frame assembly 12 includes fore-and-aft spaced apart front and rear upstanding beams 32, 34 which are fixedly attached at their lower ends upon the top wall 28 of the main body 22 of the lower base 18. The support frame assembly also includes an end cap 36 which overlies and is rigidly attached to the upper ends of the front and rear beams 32, 34. The front beam 32, being of rectangular cross-sectional configuration, defines a guide track for the vertical reciprocal movement of the lift platform assembly 14 along the upright mast 20. The rear beam 34, being of U-shaped cross-sectional configuration, encloses a vertically-extending drive screw shaft 38 of the drive arrangement 16 at the rear and opposite lateral sides of the rear beam 32. The rear beam 34 is open at its front side to permit coupling with the lift platform assembly 14 as will be described later.

Referring to FIGS. 1 and 2, one feature of the improved service lift stand apparatus 10 of the present invention relates to the drive arrangement 16 and its mounting relationship with the lift platform and support frame assemblies 12, 14 of the apparatus 10. The drive arrangement 16 includes the generally vertically-extending drive screw shaft 38, a drive motor 40 and a drive motion transmitting train 42.

The drive screw shaft 38 is mounted by the lower base 18 and the upright mast 20 of the support frame assembly 12 for rotation about a vertical longitudinal axis A. The upper end of the drive screw shaft 38 is rotatably mounted by a top bearing 44 mounted to a horizontal bracket 46 attached near the upper end of the rear beam 34 of the support frame assembly 12. The lower end of the drive screw shaft 38 extends downward through an opening 48 in the top wall 28 of the lower base 18 where it is rotatably mounted by a bottom bearing 50 mounted on the underside of the top wall 28 of the lower base 18 by bolts 52. The load of the drive screw shaft 38 is carried by a thrust bearing 54 which rests on the top wall 28 of the lower base 18 around the opening 48. The load of the drive screw shaft 38 transfers to the thrust bearing 54 through an annular collar 56 secured on the screw shaft 38 by a set screw 58 so as to underlie a downwardly-facing shoulder 60 on the screw shaft 38.

The drive motor 40, preferably a reversible electric motor, is mounted upon the top wall 28 of the lower base 18 of the support frame assembly 12. The drive motor 40 has a central output drive shaft 62 with a longitudinal rotational axis B extending generally parallel to the rotational axis A of the drive screw shaft 38. The drive motion transmitting train 42 drivingly couples the output drive shaft 62 of the drive motor 40 to the screw shaft 38. The motion transmitting train 42 is composed of an endless flexible drive belt 64 entrained over a pair of pulleys 66, 68 secured respectively on the lower ends of the drive screw shaft 38 and the output drive shaft 62 of the motor 40. The drive motor 40 is secured to the top wall 28 of the base 18 by fasteners 70 which extend through slots 72 in the top wall 28. Thus, before being secured to the top wall 28, the drive motor 40 can be moved away from the rear beam 34 to place the drive belt 64 under sufficient tension to prevent slippage of the drive belt 64 relative to the pulleys 66, 68. The fasteners 70 are then tightened to secure the drive motor 40 to the lower base 18.

In view of the above description, it will be apparent that the drive motor 40 of the drive arrangement 16 is thus positioned on the lower base 18 and spaced rearwardly from the rear beam 34 of the support frame assembly 12. The locating of the drive motor 40 on the lower base 18 serves to lower the center of gravity and thus improved the stability of the lift stand apparatus 10 and also reduce noise and vibration. The motion transmitting train 42 is located below the top wall 28 of the lower base 18 and thus is shielded by the top and side walls 28, 30 of the lower base.

Referring to FIGS. 1 and 3–5, another feature of the service lift stand apparatus 10 relates to the makeup of the lift platform assembly 14 and its mounting relationship with the support frame assembly 12 of the apparatus 10. The lift platform assembly 14 supports the work implement to be serviced. The lift platform assembly 14 includes a guide housing 74 being of a rectangular cross-sectional configuration and rotatably mounting diagonally-displaced front and rear rollers 76. The rollers 76 engage with front and rear sides of the front beam 32 for rollably guiding the guide housing 74 vertically along the guide track or path defined by the front beam 32. A coupler bracket 78 is attached to and extends rearwardly from the guide housing 74 and interengages a lift nut 80 threadly received on the drive screw shaft 38 of the drive arrangement 16. The coupler bracket 78 interfits with an annular groove 82 on the lift nut 80 so as to prevent the lift nut 80 from rotating with the drive screw shaft 38. Therefore, when selected operation of the drive motor 40 causes the screw shaft 38 to rotate in either direction, the stationary lift nut 80 will move vertically along the screw shaft 38 and cause the guide housing 74 to roll vertically along the front beam 32.

The lift platform assembly 14 also includes a support structure 84, a pair of elongated lift members 86 (only one being seen in FIG. 4), and a locking mechanism 88. The support structure 84 preferably includes a transverse tubular member 90 mounted by a pin 92 (FIG. 4) across the front side of the guide housing 74 for reciprocal movement with the guide housing in the vertical path along the front beam 32 of the upright mast 20. The mounting of the tubular member 90 to the guide housing 74 by the pin 92 also permits the tubular member 90 to be rotated about a horizontal axis defined by the pin 92 relative to the guide housing 74 and the upright mast 20. An adjustment mechanism for securing the tubular member 90 at various rotational angular positions relative the upright mast 20 is not shown.

The support structure 84 also includes a support rod 94 and a plurality of right-angle brackets 96 mounting the rod 94 in a parallel orientation along the front side of the tubular member 90. The lift members 86 are preferably composed of a pair of elongated wheel support troughs 98 and a pair of U-shaped mounting brackets 100 attached to and projecting above the same one inner ends of the troughs 98. The opposite outer ends of the troughs 98 mount ramps 102 for assisting in rolling a work implement upon the troughs 98 when the lift platform assembly 14 is in a lowered position. Also, pairs of laterally aligned holes 103 are provided in the outer sides of the troughs 98 for attaching eyebolts and straps (not shown) to the troughs 98 for use in securing an implement on the troughs.

The mounting brackets 100 of the lift members 86 have pairs of aligned holes 100A through which extends the support rod 94 for rotatably and slidably mounting the lift members 86 on the support rod 94. Thus the lift members 86 are mounted to the tubular member 90 via the support rod 94 for generally parallel pivotal movement relative thereto and for lateral movement toward and away from each other and relative to the tubular member 90 for adjusting the desired positions of the lift members 86 therealong and relative to each other to match the wheelbase of the implement.

The locking mechanism 88 of the lift platform assembly 14 is operable for releasing the lift members 86 so that their positions can be adjusted and then for locking the lift members 86 in the desired positions along the tubular member 90 for stationarily supporting the wheels of a work implement. The locking mechanism 88 includes an elongated flat plate 104 mounted along the underside of the tubular member 90 and having an edge projecting forwardly therefrom. The edge of the plate 104 has a plurality of notches 106 defined therein in spaced apart relation. The distance between the sides of the wheel support troughs 98 is equal to the displacement between several of the notches 106 such that the inner ends of the troughs 98 will mate with the notches 106 on the plate 104 at various lateral positions along the support rod 94.

The locking mechanism 88 also includes a pair of releasable lock knobs 108 having stems 110 threaded into flanges 112 fixed on and extending rearwardly from upper bight portions of the mounting brackets 100. When the knobs 108 are rotated to partially unscrew the stems 110 from the flanges 112 and displace the tips 110A of the stems 110 away from the tubular member 90, the wheel troughs 98 can be pivoted upwardly about the support rod 94 sufficiently to withdraw their inner ends from the notches 106 and permit the troughs 98 to be slid laterally along the support rod 94 to new positions. When the knobs 108 are rotated to rescrew the stems 110 into the flanges 112, bringing their tips llOA into contact with the tubular member 90, the wheel troughs 98 are then prevented from being pivoted upwardly. Thus, their inner ends are maintained interlocked within the notches 106 of the plate 104.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely preferred or exemplary embodiment thereof.

I claim:

1. A service lift stand apparatus, comprising:

(a) a support frame assembly composed of a generally horizontal lower base and a generally vertical mast mounted in an upstanding orientation on said base, said lower base including a fore-and-aft extending main body having a generally horizontal top wall;

(b) a lift platform assembly for supporting a work implement to be serviced, said lift platform assembly being mounted to said upright mast for reciprocal movement in a generally vertical path along said upright mast; and (c) a drive arrangement supported on said support frame assembly and being operable to movably drive said lift platform assembly in upward and downward directions along said upright mast away from and toward said base of said support frame assembly;

(d) said drive arrangement including a generally vertical drive screw shaft rotatably mounted to said vertical mast and said lower base, said drive screw shaft being coupled to said lift platform assembly for driving said lift platform assembly along said vertical path, said drive arrangement also including a drive motor mounted on said lower base and spaced from said vertical mast and having an output drive shaft extending generally parallel to said screw shaft, said output drive shaft of said motor and said drive screw shaft having respective lower ends extending below said top wall of said lower base, said drive arrangement further including a motion transmitting train being located below said top wall of said lower base and intercoupling said lower end of said output drive shaft of said drive motor to said lower end of said drive screw shaft;

(e) said lower base also including a pair of vertical side walls connected along and extending downwardly from longitudinal edges of said top wall of said lower base, said top wall and side walls together shielding and covering said motion transmitting train.

2. The apparatus of claim 1, wherein said motion transmitting train includes an endless flexible drive belt entrained over a pair of pulleys secured respectively on said lower ends of said drive screw shaft and said output drive shaft of said drive motor.

3. The apparatus of claim 1, wherein said drive motor is mounted upon said top wall of said lower base of said support frame assembly.

4. The apparatus of claim 3, wherein said drive motor is secured to said top wall of said lower base by fasteners which extend through slots defined in said top wall permitting the position of said drive motor on said top wall to be adjusted along said slots.

5. A service lift stand apparatus, comprising:

(a) a support frame assembly composed of a generally horizontal lower base and a generally vertical mast mounted in an upstanding orientation on said base, said lower base including a fore-and-aft extending main body having a generally horizontal top wall;

(b) a lift platform assembly for supporting a work implement to be serviced, said lift platform assembly being mounted to said upright mast for reciprocal movement in a generally vertical path along said upright mast; and (c) a drive arrangement supported on said support frame assembly and being operable to movably drive said lift platform assembly in upward and downward directions along said upright mast away from and toward said base of said support frame assembly;

(d) said drive arrangement including a generally vertical drive screw shaft rotatably mounted to said vertical mast and said lower base, said drive screw shaft being coupled to said lift platform assembly for driving said lift platform assembly along said vertical path, said drive arrangement also including a drive motor mounted on said lower base and spaced from said vertical mast and having an output drive shaft extending generally parallel to said drive screw shaft, said drive arrangement further including a motion transmitting train intercoupling said output drive shaft of said drive motor to said drive screw shaft, said drive motor being mounted upon and secured to said top wall of said lower base by fasteners which extend through slots defined in said top wall permitting the position of said drive motor on said top wall to be adjusted along said slots.

6. The apparatus of claim 5, wherein respective lower ends of said drive screw shaft and said output drive shaft of said motor extend below said top wall of said lower base, said motion transmitting train intercoupling said motor output drive shaft with said drive screw shaft at said lower ends thereof located below said top wall of said lower base.

7. The apparatus of claim 5, wherein said motion transmitting train intercouples said motor output drive shaft with said drive screw shaft below said top wall of said lower base.

8. The apparatus of claim 7, wherein said motion transmitting train includes an endless flexible drive belt entrained over a pair of pulleys secured respectively on lower ends of said drive screw shaft and said output drive shaft of said drive motor.

9. A service lift stand apparatus, comprising:

(a) a support frame assembly composed of a generally horizontal lower base and a generally vertical mast mounted in an upstanding orientation on said base;

(b) a lift platform assembly for supporting a work implement to be serviced, said lift platform assembly including a support structure mounted to said upright mast for reciprocal movement in a generally vertical path along said upright mast, a pair of lift members mounted to said support structure for generally parallel pivotal movement relative to said support structure and for lateral movement toward and away from each other and relative to said support structure for adjusting the desired positions of said lift members along said support structure and relative to each other, and means for locking said lift members in the desired positions along said support structure for supporting the work implement; and (c) a drive arrangement supported on said support frame assembly and being operable to movably drive said lift platform assembly in upward and downward directions along said upright mast away from and toward said base of said support frame assembly.

10. The apparatus of claim 9, wherein said support structure includes:

an elongated member; and a support rod spaced from and oriented generally parallel to said elongated member.

11. The apparatus of claim 10, wherein said lift members include a pair of elongated wheel support troughs pivotally mounted at respective inner ends to said support rod independently of one another.

12. The apparatus of claim 11, wherein said lift members include ramps mounted to respective outer ends of said wheel support troughs.

13. The apparatus of claim 11, wherein said locking mechanism is operable for releasing said lift members so that their positions can be adjusted along said support rod and then for locking said lift members in the desired positions along said support rod.

14. The apparatus of claim 13, wherein said locking mechanism includes an elongated element mounted along said elongated member and having an edge projecting outwardly therefrom, said edge having a plurality of notches defined therein in spaced apart relation from one another.

15. The apparatus of claim 14, wherein said inner ends of said wheel support troughs mate with said notches at various lateral positions along said support rod.

16. The apparatus of claim 15, wherein said locking mechanism also includes a pair of releasable lock elements being actuatable into and from locking positions relative to said elongated member for corresponding permitting and preventing pivotal movement of said wheel support troughs relative to said elongated member about said support rod and thereby withdrawal of said inner ends of said wheel support troughs from mating relation with said notches for laterally moving said troughs along said support rod.

17. The apparatus of claim 16, wherein said lock elements are knobs being threadable into and from said locking positions relative to said elongated member.

* * * * *